United States Patent [19]

Kon et al.

[11] Patent Number: 4,789,565

[45] Date of Patent: Dec. 6, 1988

[54] METHOD FOR THE PRODUCTION OF A THERMAL FIXING ROLLER

[75] Inventors: Shuji Kon, Sagamihara; Yuji Suzuki, Yokosuka; Toshimitsu Iwata, Sagamihara; Junichi Fukahori, Yokohama, all of Japan

[73] Assignee: Showa Electric Wire & Cable Co., Ltd., Kanagawa, Japan

[21] Appl. No.: 110,736

[22] Filed: Oct. 21, 1987

[30] Foreign Application Priority Data

Oct. 30, 1986 [JP] Japan ..... 61-259172
Oct. 31, 1986 [JP] Japan ..... 61-260164
Oct. 31, 1986 [JP] Japan ..... 61-260165
Oct. 31, 1986 [JP] Japan ..... 61-261486

[51] Int. Cl.[4] ..... B05D 3/02

[52] U.S. Cl. ..... 427/375; 427/377; 427/379; 427/387; 427/388.1; 427/393.5; 427/409; 427/430.1

[58] Field of Search ..... 427/375, 377, 379, 387, 427/388.1, 393.5, 409, 430.1, 435, 388.4

[56] References Cited

U.S. PATENT DOCUMENTS 3,852,861 12/1974 Baker et al. ..... 427/379
3,967,000 6/1976 Klein et al. ..... 427/435
4,196,256 4/1980 Eddy et al. ..... 427/409
4,313,981 2/1982 Namiki ..... 427/409
4,430,406 2/1984 Newkirk et al. ..... 427/409
4,522,866 6/1985 Nishikawa et al. ..... 427/393.5
4,707,387 11/1987 Sakane et al. ..... 427/393.5

*Primary Examiner*—Sadie Childs
*Attorney, Agent, or Firm*—Finnegan, Henderson, Farabow, Garrett, & Dunner

[57] ABSTRACT

The present invention relates to method for the production of a thermal fixing roller which comprises steps of applying a silicone rubber layer to the surface of a shaft, thereby forming a silicone rubber roller, applying a polytetrafluoroethylene coating to the surface of the silicone rubber roller by immersing the roller in a polytetrafluoroethylene dispersion and rotating the silicone rubber roller in a plane inclined with respect to a horizontal plane, removing the silicone rubber roller from the polytetrafluoroethylene resin dispersion, drying the coating on the outside of the silicone rubber roller at a temperature of at least 500° C. for 10 to 120 seconds, preheating the coating from the inside of the silicone rubber roller, thereby elevating the temperature of the coating to a temperature which is less than that of the melting point of the polytetrafluoroethylene resin, and baking the coating to a temperature which is at least that of the melting point of the polytetrafluoroethylene resin.

12 Claims, 1 Drawing Sheet

METHOD FOR THE PRODUCTION OF A THERMAL FIXING ROLLER

The present application claims priority of Japanese patent application No. 61-259172 filed on Oct. 30, 1986, and No. 61-260164, No. 61-260165 and No. 61-261486 filed on Oct. 31, 1986, respectively.

FIELD OF THE INVENTION AND RELATED ART STATEMENTS

It has been customary to use as a thermal fixing roller in the thermal fixing part of an electrophotographic copying machine what is obtained by applying a coating of such fluorine resin as PTFE (tetrafluoroethylene resin) or PFA (perfluoroalkoxy resin) through the medium of a primer on a core shaft of such a metal as aluminum or what is obtained by applying an undercoat of such a rubbery material as fluorine rubber or silicone rubber through the medium of a primer on the core shaft and covering the rubber undercoat with a coating of fluorine resin.

In recent years, a need has been urged for further improving the electrophotographic copying machine in operational speed, functional efficiency, economy, and ability to produce pictures of high quality. In this respect, the conventional thermal fixing rollers pose the following problems.

In the case of the thermal fixing roller having a coating of fluorine resin applied via a primer on the core shaft, though the roller itself enjoys highly satisfactory durability, it tends to produce pictures of inferior quality and impart wrinkles to the copying paper.

In the case of the thermal fixing roller having a coating of fluorine rubber applied on the core shaft, though the roller has satisfactory durability and produces picture of satisfactory quality, the roller exhibits poor thermal response and tends to suffer from fall of surface temperature and poor fixation of pictures. This fact poses itself a serious problem particularly when the roller is used in a high-speed copying machine. There is another problem that the fluorine rubber is expensive.

Further, in the case of the thermal ixing roller having a coating of silicone rubber applied on the core shaft, though the material of the undercoat is inexpensive and the roller in the early stage of service exhibits highly satisfactory performance in terms of effect of fixation, quality of produced pictures, and ease of paper passage, the roller has a disadvantage that the silicone rubber is susceptible to thermal deterioration and consequently devoid of durability.

Recently, the practice of applying powdery perfluoroalkoxyethylene resin by the technique of electrostatic painting on the silicone rubber undercoat and baking the applied layer of the powder thereby forming a perfluoroalkoxyethylene layer for the purpose of improving the ability of the roller to effect through release of the toner has been gaining in popularity. Unfortunately, however, the roller coated with the perfluoroalkoxyethylene resin layer is deficient in mechanical strength and surface smoothness.

Conceivably, a thermal fixing roller capable of producing pictures of high quality and excellent in fixing property and paper-passing property could be obtained if a PTFE (polytetrafluoroethylene) coat of smooth surface was formed by using a PTFE dispersion on a silicone rubber layer applied in advance on a core shaft. When the PTFE dispersion is used, since the maximum thickness of the layer of this dispersion obtained at all is only about 20 μm, the produced PTFE coat is liable to sustain a crack. Further, since the PTFE possesses extremely high melt viscosity as widely known, it cannot be expected to exhibit desirable flowability while in a molten state and the crack sustained in the PTFE coat persists even after the coat is bakes. Moreover, since the adhesive force keeping the PTFE layer and the silicone rubber layer in fast union is weak, there is a disadvantage that the produced thermal fixing roller is deficient in durability.

This is another disadvantage that since the PTFE coat is generally baked at a high temperature, the silicone rubber layer which constitutes itself a base for the PTFE coat is inevitably exposed to the high temperature and consequently deteriorated by the heat. To be specific, the PTFE coat is generally baked in an atmosphere kept at about 380° C. over a period of some tens of minutes. Under these conditions, since the melt viscosity of PTFE is very high, the crack generated during the course of drying persists even after the baking and seriously degrades the roller's qualities such as durability and thermal fixing property. Moreover, the baking treatment entails a disadvantage that the baking temperature is so high for the silicone rubber layer that this layer will be thermally deteriorated.

U.S. Pat. No. 3,435,500 discloses a thermal fixing roller having a tube of a fluorinated ethylene-propylene copolymer wrapped around a silicone rubber layer applied in advance on a core shaft and U.S. Pat. No. 3,912,901 discloses a thermal fixing roller having a tube of a copolymer of tetrafluoroethylene and perfluoroalkylperfluorovinyl ether wrapped around a silicone rubber layer applied in advance on a core shaft. These thermal fixing rollers have a disadvantage that the rollers using these fluorine type resins are produced in a desired outside diameter with poor accuracy as compared with those using the PTFE dispersion, the rollers are liable to produce pictures of poor quality because these fluorine type resins possess a fixing property inferior to that of PTFE, and the rollers are deficient in durability because the fluorine type resins possess lower heat resistance than PTFE.

OBJECTS OF THE INVENTION

A primary object of this invention is to provide a method for the production of a thermal fixing roller possessing a smooth crackless PTFE coating in the outermost layer thereof and enjoying highly satisfactory roller qualities such as in fixing property, picture quality, precised outside diameter and paper-passing property enough to meet the recent years' needs for high operational speed and high functional efficiency.

Another object of this invention is to provide a method for the production of a thermal fixing roller having a PTFE coating applied intimately as an outermost layer on a silicone rubber layer and enjoying improved durability.

Yet another object of this invention is to provide a method for the production of a thermal fixing roller of highly desirable qualities by enabling the PTFE coating to be baked without entailing thermal deterioration of the silicone rubber layer underlying the PTFE coating.

BRIEF DESCRPTION OF THE DRAWINGS

DETAILED DESCRIPTION OF PREFERRED EMBODIMENT

Figure 1:
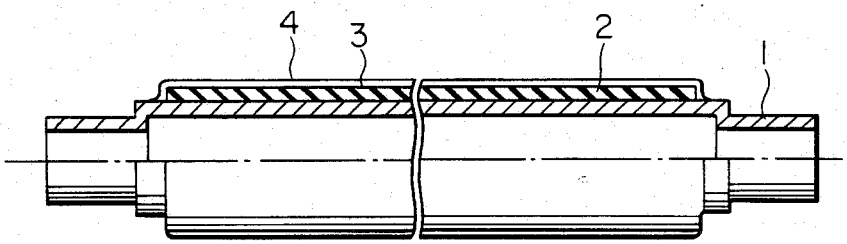
FIG. 1 is a partial cross section of the thermal fixing roller according to the present invention.

The thermal fixing roller of the present invention basically comprises, as illustrated in FIG. 1, a hollow cylindrical core shaft member 1 made of a metal, a thermally vulcanized silicone rubber layer 2 applied in a thickness of 0.05 to 0.8 mm on the periphery of the core shaft, a fluorine type primer layer 3 formed on the silicone rubber layer, and a smooth PTFE coating 4 formed in a thickness of 10 to 30 μm on the fluorine type primer layer by thermal fusion of an applied layer of PTFE dispersion.

This thermal fixing roller is basically produced by the method which comprises, (a) a step of applying a silicone rubber layer to the surface of a shaft, thereby forming a silicone rubber roller, (b) a step of applying a polytetrafluoroethylene coating to the surface of the silicone rubber roller by immersing the roller in a polytetrafluoroethylene resin dispersion and rotating the silicone rubber roller in a plane inclined with respect to a horizontal plane;

(c) a step of removing the silicone rubber roller from the polytetrafluoroethylene resin dispersion;

(d) a step of drying the coating on the outside of the silicone rubber roller at a temperature of at least 500° C. for 10 to 20 seconds;

(e) a step of preheating the coating from inside the silicone rubber roller, thereby elevating the temperature of the coating to a temperature which is less than that of the melting point of the polytetrafluoroethylene resin; and (f) a step of baking the coating to a temperature which is at least that of the melting point of the polytetrafluoroethylene resin.

Suitably for this invention, the aforementioned silicone rubber is obtained by thermally vulcanizing a composition which proves to be desirable because it adheres intimately with the PTFE coat and serves the purpose of improving the durability of the roller.

In the present invention, it is desirable to have a fluorine type primer applied on the silicone rubber layer for the purpose of enhancing the adhesiveness of the PTFE coat with the silicone rubber layer.

The primer to be used for this purpose can be any of the conventional compounds usable as an undercoat for fluorine resin layers. Among other compounds meeting the description, those made of polymers containing fluorine resin and a coupling agent as typified by P-110 (product of Asahi Glass Company, Ltd.) prove to be particularly suitable.

By the use of the fluorine type primer described above, the fastness of adhesion between the PTFE coat and the rubber layer can be heightened to a great extent.

As concrete examples of the fluorine resin to be used for the PTFE dispersion contemplated by the present invention, there can be cited AD-1 and AD-639 (products of Asahi Glass Company, Ltd.), D-1 and D-2 (products of Daikin Kogyo Co., Ltd.), and 30-J (product of Mitsui-DuPont Fluorochemical Co., Ltd.).

The PTFE dispersion to be used generally has a PTFE concentration in the range of 57 to 60% by weight.

If the PTFE concentration deviates the range mentioned above, it becomes difficult to form a PTFE coat in a thickness enough for the PTFE coat to manifest sufficient mechanical strength, specifically a thickness in the range of 10 to 30 μm after baking.

Desirably, the PTFE dispersion incorporates therein a fluorine type surfactant for the purpose of preventing the PTFE coat from producing a crack.

In the present invention, the PTFE dispersion may incorporate therein, when necessary, a defoaming agent in addition to the aforementioned surfactant.

The method for the production of the thermal fixing roller of the present invention is as follows.

First, a hollow cylindrical core shaft made of such a metal as aluminum is subjected to a blasting treatment, a cleaning treatment, and a defatting treatment, for example, and then coated on the peiphery thereof with a primer.

Separately, the components as starting materials for the silicone rubber are weighed out in prescribed amounts and mixed in an ordinary mixing machine such as a mixing roll or a banbury mixer.

Then, the silicone rubber composition in an unvulcanized state is applied in a layer on the core shaft and the applied composition is vulcanized to form a tubular silicone rubber layer adhering fast to the core shaft. Subsequently, the surface of the silicone rubber layer, when necessary, is ground to produce a perfectly tubular layer of smooth surface having a thickness is of 0.05 to 0.8 mm. Optionally, the opposite ends of the tubular layer may be shaped in the form of a slightly backwardly bent crown or a reversed crown.

Then, on the surface of the rubber layer, the aforementioned fluorine type primer is applied in a thickness of 0.1 to 7 μm, preferably 0.3 to 2 μm, by the spray method, for example. The applied layer of the primer is dried by blowing hot air kept at a temperature of about 80° to 100° C. on the surface thereof and then heat treated at a temperature of 150° to 250° C., preferably 180° to 220° C., for a period of 10 to 30 minutes.

Figure 2:
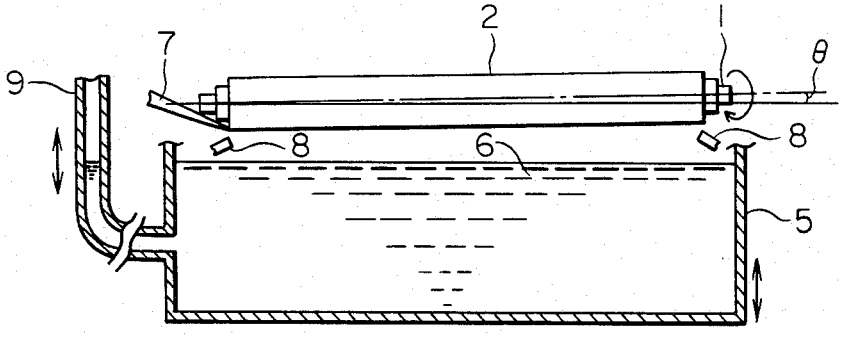
FIG. 2 is a diagram schematically illustrating the method of production according to the present invention.

Now, the core shaft 1 having the silicone rubber layer 2 formed thereon is held in a state slightly tilted by an angle, $\theta$, to the horizontal plane as illustrated in FIG. 2 so as to be vested with an improved ability to drain liquid and rotated at a speed of about 4 rpm over the PTFE dispersion 6 held in an immersion bath 5. With the core shaft 1 kept so rotated, the level of the PTFE dispersion is gradually elevated until the surface of the silicone rubber layer 2 is wholly immersed in the PTFE dispersion. Then, the level of the PTFE dispersion is lowered. Desirably in this case, the rotational speed of the roller after the liquid phase separates from the roller is lower than that of the roller before the immersion.

The environment of coating and the roller are desired to be kept at a temperature in the range of 5° to 20° C. (preferably 8° to 12° C.), i.e. a level lower than the normal room temperature, and the humidity of the environment is desired to be 30% or more, preferably to fall in the range of 50 to 70%. Table 1 shows the results of evaluation of the quality of the coat formed under varying environmental temperature and humidity (in the absence of air current). The data clearly indicate that the environmental temperature and humidity affect the quality of the formed coat. In the table, the mark o represents a smooth surface showing no discernible crack, the mark Δ represents partial occurrence of cracks or partial loss of surface smoothness, and the mark x represents occurrence of cracks all over the coat and total absence of surface smoothness.

TABLE 1

| Temperature (°C.) | Humidity (%) 10 | 20 | 30 | 40 | 50 | 60 | 70 | 80 | 90 |
|---|---|---|---|---|---|---|---|---|---|
| 5 | x | x | x | x | x | x | x | x | x |
| 10 | Δ | Δ | O | O | O | O | O | O | Δ |
| 12 | Δ | Δ | O | O | O | O | O | Δ | Δ |
| 15 | Δ | Δ | O | O | O | O | O | O | Δ |
| 18 | Δ | Δ | O~Δ | O~Δ | O~Δ | O~Δ | O~Δ | O~Δ | Δ |
| 20 | Δ | Δ | O~Δ | O~Δ | O~Δ | O~Δ | O~Δ | O~Δ | Δ |
| 25 | x | x | Δ | Δ | Δ | Δ | Δ | Δ | x |
| 30 | x | x | x | Δ~x | Δ~x | Δ~x | Δ~x | Δ~x | x |
| 35 | x | x | x | x | x | x | x | x | x |
| 40 | x | x | x | x | x | x | x | x | x |

After the core shaft 1 has been rotated a number of times in the PTFE dispersion, the level of the PTFE dispersion is lowered until the silicone rubber roller is taken out of the PTFE dispersion. The portion of the dispersion which has flowed down the roller surface is removed by contact with a draining member 7. Then, the silicone rubber roller is kept rotated until the spiral lines caused by the bias of the dispersion disappears. In this case, the smoothness of the surface of the produced coat can be enhanced by lowering the rotational speed of the roller after removal from the PTFE dispersion to about one half of that during the immersion.

Optionally, suction nozzles 8 of an aspirator may be disposed one each near the opposite ends of the roller and, after the roller has been removed from the PTFE dispersion land while the adhering dispersion is still retaining flowability and the roller is still kept rotating, the suction nozzles 8 may be operated so as to draw the dispersion toward the opposite ends of the roller. This treatment precludes the otherwise possible formation of circular ridges of adhering dispersion on the surface of the roller and enables the PTFE layer to be finished with a uniform and smooth surface.

The vertical change of the level of the PTFE dispersion in the immersion bath 5 can be accomplished by having one end of a flexible pipe 9 of a suitable diameter connected to the immersion bath 5 and moving the other end of the flexible pipe 9 up or down thereby causing the PTFE dispersion inside the pipe 9 to be moved into or out of the bath.

After the PTFE dispersion adhering to the roller has uniformed, the PTFE coat is dried at an elevated temperature for a brief pleriod to expel the remaining volatile component and impart to the roller an ability to preclude occurrence of a crack during the course of the preheating treatment and the baking treatment which are to be described fully later on.

The drying of the coat is carried out at a temperature of not less than 500° C. preferably falling in the range of 500° to 800° C. The drying time is in the range of 10 to 120 seconds. As shown in Table 2, the coat tends to sustain a crack if the drying temperature is less than 500° C. and the silicone rubber layer is thermally deteriorated if the drying temperature exceeds 800° C. By causing the drying of the coat to be carried out at the temperature for the period both specified above, the otherwise possible occurrence of a crack in the PTFE coat during the preheating treatment and the baking treatment can be precluded and the thermal deterioration of the silicone rubber layer can also be prevented.

TABLE 2

| Temparature (°C.) | Time (second) 30 | 60 | 90 | 120 | 150 | 180 |
|---|---|---|---|---|---|---|
| 100 | x | x | x | x | x | x |
| 200 | x | x | x | x | x | x |
| 300 | x | x | x | x | x | x |
| 400 | Δ | Δ | Δ | Δ | Δ | Δ |
| 500 | O | O | O | O | O | Δ x |
| 600 | O | O | O | O | Δ x | Δ x |
| 700 | O | O | O | Δ x | Δ x | Δ x |
| 800 | O | O | Δ x | x x | x x | x x |

Table 2 shows the results of the occurence of cracks in the PTFE coat and the existence of the thermal deterioration of the silicone rubber layer, obtained by changing drying conditions, i.e., heating temperatures and heating time. In the table, the mark x represents wholly extending cracks, the mark Δ represents partial occurence of cracks, and the mark o represents no discernible crack. Further, the mark x represents the thermal deterioration of the silicone rubber layer.

The silicone rubber roller and the PTFE dispersion used herein is same as the above mentioned example.

This drying can be attained by simply holding the roller in an atmosphere kept heated at a temperature in the aforementioned range. Optionally, this drying may be accelerated by having a heating member inserted in the core shaft of the roller or by keeping the roller rotated and blowing a current of hot air on the surface of the roller at a speed of about 0.5 to 2.5 m/s.

Then, the roller which has been dried is subjected to a preheating treatment prior to a baking treatment.

This preheating treatment is desired to be continued until the temperature of the PTFE coat reaches a level not exceeding the melting point and falling in the range of 230° to 320° C., preferably 240° to 280° C. If the preheating temperature is less than 230° C., the baking time must be increased so much that the silicone rubber layer will be deteriorated by the heat used in the baking treatment. If the preheating temperature exceeds 320° C., the preheating treatment itself will possibly deteriorates the silicone rubber layer.

This preheating treatment is carried out by inserting heating means such as an infrared heater into the core shaft of the roller or by induction heating the core shaft thereby applying heat to the silicone rubber from within. The heat applied to the roller from outside may be utilized at the same time. If the outwardly applied heat is exclusively utilized for the preheating treatment, it entails a disadvantage that since the preheating time must be much longer in order for the temperature to reach the aforementioned level, the silicone rubber layer is inevitably deteriorated owing to the protracted exposure thereof to the heat. In the case of the preheating treatment which is required to elevate the roller temperature to 270° C., for example, the time required by the treatment effected by the use of the heater inserted in the core shaft is only 3 minutes, that by the treatment effected by the induction heating is only some tens of seconds, and that by the treatment effected exclusively by the heat applied from outside is as much as 40 minutes.

Subsequently to the preheating treatment, the roller is placed in a constant temperature bath, to be baked therein at a temperature of not less than the melting point of PTFE, preferably falling in the range of 500° to 800° C., for a period of some tens of seconds to about 180 seconds. By this treatment the PTFE layer is fused and allowed to form a crackless smooth layer. In this case, the time consumed for the baking treatment can be shortened by having hot bar heater adapted for ready insertion into the core shaft and disposed in advance inside the constant temperature bath, allowing this hot bar heater to enter the core shaft of the roller while the roller is placed in the constant temperature bath, and enabling the roller to be heated simultaneously on the inside and outside.

After the baking treatment, the hot roller is desired to be suddenly cooled because the silicone rubber layer would be deteriorated thermally if the hot roller was left standing at rest. By the sudden cooling, the silicone rubber is prevented from the unwanted thermal deterioration and the PTFE coat is allowed to acquire smoothness of surface.

This sudden cooling is accomplished by flowing water, silicone oil, or some other liquid substance through the core shaft.

Now, the present invention will be described more specifically below with reference to a working example.

EXAMPLE 1

Then, a thermally vulcanizing silicone rubber composition was applied in the form of a coat on a core shaft (50 mm in outside diameter and 320 mm in barrel length) made of aluminum and coated in advance on the surface thereof with a primer, No. 18 B (product of Shinetsu Chemical Industry Co., Ltd). The coated core shaft was placed in a metal mold and subjected therein to primary vulcanization under the conditions of 160° C.×30 minutes. It was then removed from the metal mold and subjected to secondary vulcanization under the conditions of 200° C.×4 hours. Subsequently, the surface of the coated core shaft was ground to form a silicone rubber layer 0.5 mm in thickness. This silicone rubber layer, with a fluorine resin containing primer (P-110) applied therein, was subjected to baking under the conditions of 200° C.×40 minutes.

The roll consequently obtained was held directly above the liquid level of an immersion bath (environmental condition: temperature of 10° C., humidity of 60%) containing a PTFE dispersion (product of Asahi Glass Company, Ltd. marketed under product code of "AD-1") with the core shaft thereof slightly tilted from the horizon, and kept rotating. The liquid level of the PTFE dispersion was raised until the lower part of the roll was immersed in the dispersion. Then, the liquid level was lowered and the rotational speed of the roll was changed to 2 rpm. The rotation of the roll was continued until the PTFE dispersion adhering to the surface of the roll uniformed.

Subsequently, the roll was inserted in a constant temperature bath kept at 600° C., held therein for 20 seconds, and removed from the bath. Thereafter, the roll was inserted into an induction coil, heated to a surface temperature of 240° to 260° C. by flowing an alternating current through the induction coil, and kept at this temperature for 30 seconds. Then, the roll was placed in a constant temperature bath and a heater was inserted into the core shaft to keep the surface temperature of the roll at 330° to 360° C. for 30 seconds, bake the PTFE coat, and form a PTFE coat 18 μm in thickness.

The PTFE-coated silicone rubber roll consequently obtained was tested for adhesive strength between the silicon rubber layer and the PTFE coat at normal room temperature and at the working temperature. It was also tested for durability in actual service. The results are shown in Table 3.

TABLE 3

| | | Example 1 |
|---|---|---|
| Adhesive strength (g/cm) | Room temperature | 80~120 |
| | 200° C. | 160~180 |
| Durability (outward appearance of roller) | No sign of abnormality observed after passage of 200,000 sheets of paper. | |

What is claimed is:

1. A method for the production of a thermal fixing roller comprising the steps of:
   (a) applying a silicone rubber layer to the surface of a shaft, thereby forming a silicone rubber roller;
   (b) applying a polytetrafluoroethylene coating to the surface of the silicone rubber roller by immersing the roller in a polytetrafluoroethylene resin dispersion and rotating the silicone rubber roller in a plane inclined with respect to a horizontal plane;
   (c) removing the silicone rubber roller from the polytetrafluoroethylene resin dispersion;
   (d) drying the coating on the outside of the silicone rubber roller at a temperature of at least 500° C. for 10 to 120 seconds;
   (e) preheating the coating from inside the silicone rubber roller, thereby elevating the temperature of the coating to a temperature which is less than that of the melting point of the polytetrafluoroethylene resin; and
   (f) baking the coating to a temperature which is at least that of the melting point of the polytetrafluoroethylene resin.

2. The method according to claim 1, wherein said step (b) is carried out in an atmosphere kept at a temperature of not more than 20° C.

3. The method according to claim 1 or claim 2, wherein said step (b) is carried out in an atmosphere kept at a humidity of not less than 30%.

4. The method according to claim 1, wherein the polytetrafluoroethylene resin concentration in said polytetrafluoroethylene resin dispersion is in the range of 57 to 60% by weight.

5. The method according to claim 1, wherein said silicone rubber layer is deposited on the periphery of said shaft in the form of a crown.

6. The method according to claim 1, wherein an immersion bath is provided with liquid level adjusting means for adjusting the height of liquid level.

7. The method according to claim 6, wherein said silicone rubber roller is immersed in said polytetrafluoroethylene resin dispersion and pulled out of said bath as kept in rotation.

8. The method according to claim 1 or claim 7, wherein the rotational speed of said silicone rubber roller after said roller is separated from the liquid phase of said dispersion is lower than that before said immersion.

9. The method according to claim 1, wherein after said silicone rubber roller is immersed in said polytetrafluoroethylene resin dispersion and pulled out of said dispersion and while said dispersion adhering to said silicone rubber roller is still retaining flowability, said dispersion is drawn toward the opposite ends of said silicone rubber roller from the points near said opposite ends of said silicone rubber roller.

10. The method according to claim 1, wherein said baking is effected by keeping said silicone rubber roller in a heated atmosphere and having heating means inserted in the shaft of said roller.

11. The method according to claim 1, wherein said silicone rubber roller having undergone said baking is cooled by passing a liquid coolant through the shaft of said roller.

12. The method defined in claim 1 wherein said preheating step includes elevating the temperature of the coating to a temperature between 230° C. to 320° C.

* * * * *